US006003947A

United States Patent [19]

Rye

[11] Patent Number: 6,003,947

[45] Date of Patent: Dec. 21, 1999

[54] ADJUSTABLE CHAIR ARM

[76] Inventor: Ralph K Rye, 1559 College Ave., SE., Grand Rapids, Mich. 49507

[21] Appl. No.: 09/112,304

[22] Filed: Jul. 9, 1998

Related U.S. Application Data

[60] Provisional application No. 60/052,116, Jul. 10, 1997.

[51] Int. Cl.[6] ..... A47C 7/54

[52] U.S. Cl. ..... 297/411.38; 247/411.32; 74/531; 188/67

[58] Field of Search ..... 297/113, 411.32, 297/411.38, 115; 74/531; 188/67

[56] References Cited

U.S. PATENT DOCUMENTS

| | | | |
|---|---|---|---|
| 4,496,190 | 1/1985 | Barley | 297/411.38 |
| 4,621,864 | 11/1986 | Hill | 297/411.38 X |
| 4,872,727 | 10/1989 | Rye . | |
| 4,969,686 | 11/1990 | Germain | 297/411.32 |
| 5,076,645 | 12/1991 | Yokota | 297/411.32 |
| 5,169,207 | 12/1992 | Rye . | |
| 5,409,297 | 4/1995 | De Filippo | 297/411.38 X |

FOREIGN PATENT DOCUMENTS

| | | | |
|---|---|---|---|
| 2935946 | 3/1981 | Germany . | |
| 1256977 | 12/1971 | United Kingdom | 297/411.38 |

*Primary Examiner*—Peter R. Brown

[57] ABSTRACT

An adjustable chair arm is used with a chair that has a base, a seat supported by the base, and a back connected with the base. The arm is an elongated member that is connected with the base and has two opposing ends. An arm adjustment device is interposed between the arm and the base and has a drive rod, a frame, a torque member, a brake, and a brake actuator. The frame holds the drive rod in rotating engagement. The torque member is connected between the frame and the drive rod and applies a torsional force to the drive rod. The brake has a locked mode and a released mode and holds the drive rod in preselected rotational positions, relative to the frame. The brake actuator manipulates the brake between the locked and released modes.

10 Claims, 7 Drawing Sheets

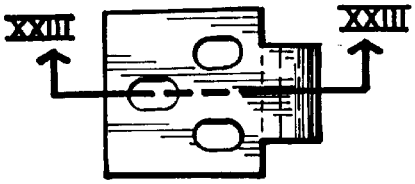
Fig. 22
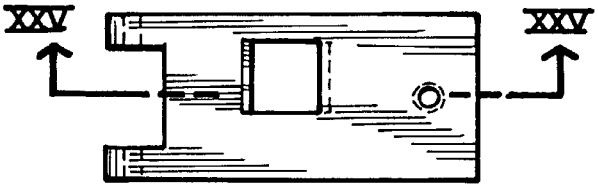
Fig. 24
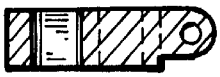
Fig. 23
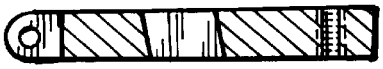
Fig. 25
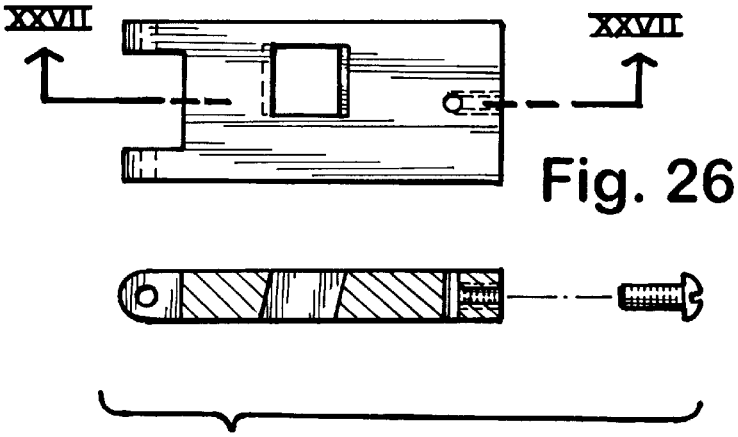
Fig. 26
Fig. 27
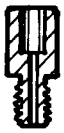
Fig. 28

ADJUSTABLE CHAIR ARM

CROSS-REFERENCES TO RELATED APPLICATIONS

This is a continuation in part of provisional application Ser. No. 60/052,116, entitled Adjustable Chair Arm and filed on Jul. 10, 1997, by Ralph K Rye, the disclosure of which is incorporated here by reference.

STATEMENT REGARDING FEDERALLY SPONSORED RESEARCH OR DEVELOPMENT

Not Applicable.

BACKGROUND OF THE INVENTION

The invention relates to chairs and the like, and more specifically to chairs that have arms with an adjustable height.

BRIEF SUMMARY OF THE INVENTION

Accordingly, an adjustable chair arm of the invention is used with a chair that has a base, a seat supported by the base, and a back connected with the base. The arm is an elongated member that is connected with the base and has two opposing ends. An arm adjustment device is interposed between the arm and the base and has a drive rod, a frame, a torque member, a brake, and a brake actuator. The frame holds the drive rod in rotating engagement. The torque member is connected between the frame and the drive rod and applies a torsional force to the drive rod. The brake has a locked mode and a released mode and holds the drive rod in preselected rotational positions, relative to the frame. The brake actuator manipulates the brake between the locked and released modes.

These and other features, objects, and benefits of the invention will be recognized by one having ordinary skill in the art and by those who practice the invention, from the specification, the claims, and the drawing figures.

BRIEF DESCRIPTION OF THE SEVERAL VIEWS OF THE DRAWING

FIG. 22 is a top plan view of a brake hinge;

FIG. 23 is a cross-sectional view along section line XXIII—XXIII of FIG. 22;

FIG. 24 is a top plan view of a top brake plate;

FIG. 25 is a cross-sectional view thereof, along section line XXV—XXV of FIG. 24;

FIG. 26 is a top plan view of a bottom brake plate;

FIG. 27 is a cross-sectional view thereof, along section line XXVII—XXVII of FIG. 26;

FIG. 28 is a cross-sectional view of a brake cable seat;

DETAILED DESCRIPTION OF THE INVENTION

Figure 1:
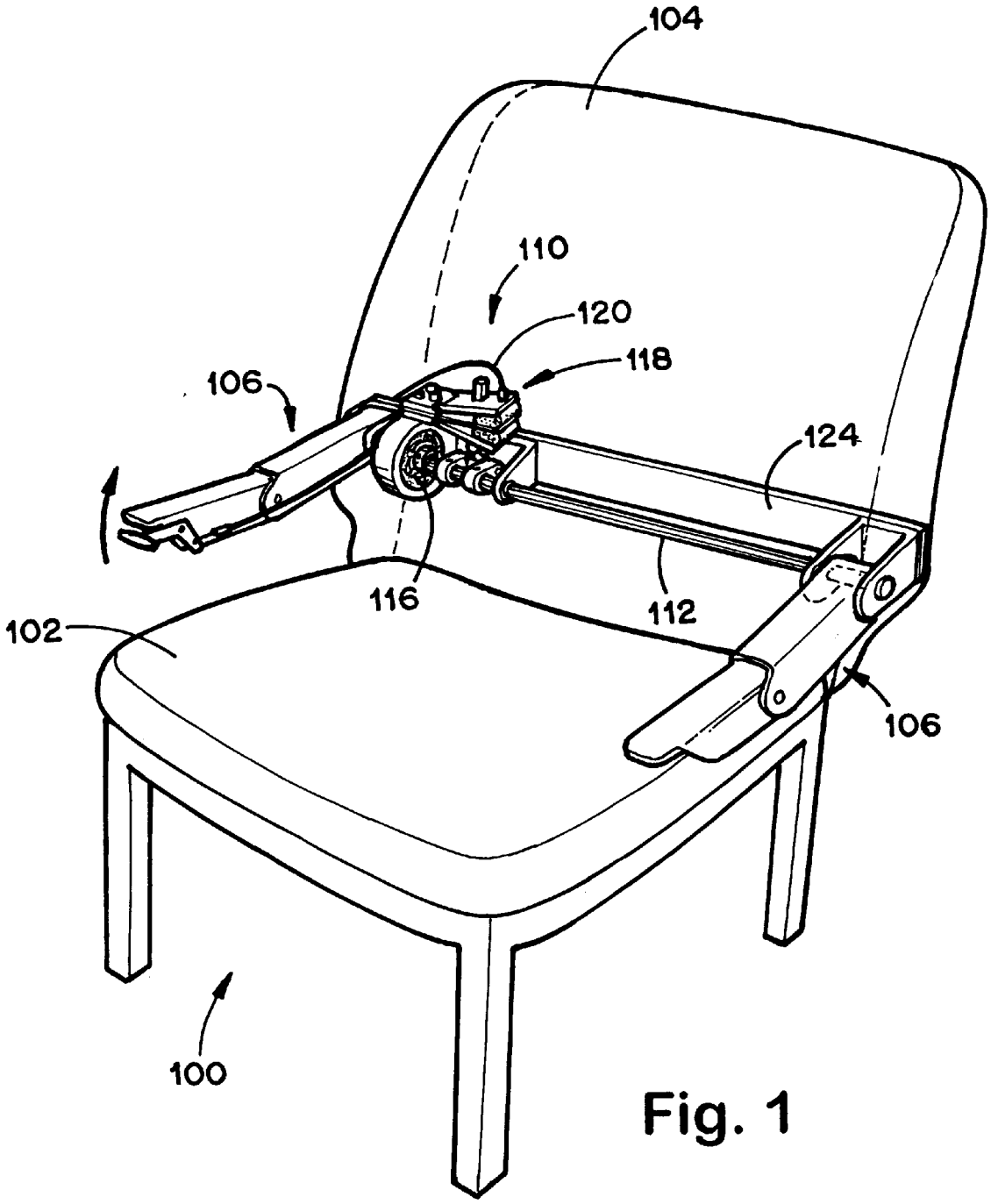
FIG. 1 is a fragmentary prospective view of a chair with an adjustable arm according to the invention.

A chair having adjustable arms according to the invention is generally shown in drawing FIG. 1. The chair has a base 100, a seat 102 supported by the base 100, a back 104 connected with the base 100, typically two arms 106 connected with the base 100, and an arm adjustment device 110 interposed between the arms 106 and the base 100. The arm adjustment device 110 is generally shown throughout the drawing figures, and further has a drive rod 112, a frame 114 adapted to hold the drive rod 112 in rotatable engagement, a torque member 116 operatively connected between the frame 114 and the drive rod 112, a brake 118 operatively connected between the frame 114 and the drive rod 112, and a brake actuator 120 operatively connected with the brake 118.

One having ordinary skill in the art will appreciate the fact that an arm adjustment device of the invention may be implemented in numerous embodiments, depending upon the preferences of the user. One, exemplary embodiment is generally shown in the drawing figures, generally identified by reference number 110, and more specifically discussed below. In this embodiment, a support extends generally transversely across the chair back to support the arm adjustment device 110 and a pair of arms 106 on a front side of the support. The drive rod 112 is shown as a straight, one-piece member that interconnects the two arms 106 at rearward ends of the arms. In possible alternative embodiments, an arm adjustment device may be mounted on a back side of the support. Also, the support might extend arcuately across the chair and the drive rod 112 may be a multi-segmented member with the segments being articulately interconnected for the drive rod 112 to follow the arc of the support. Again, these are merely exemplary, not limiting, alternative embodiments in which one having ordinary skill in the art may incorporate the invention.

Addressing the drawings more specifically, the frame 114 may be a generally E-shaped member, having three flanges extending in the same general direction from a web. The two end flanges are drilled or bored or the like, to receive bearings or bushings or the like, to support the drive rod 112. The middle flange is significantly thicker than the end flanges and is milled to receive the torque member 116. The frame 114 is also provided with various mounting holes that may be required for use of the arm adjustment device, including to mount the brake 118 to the frame 114.

Figure 2:
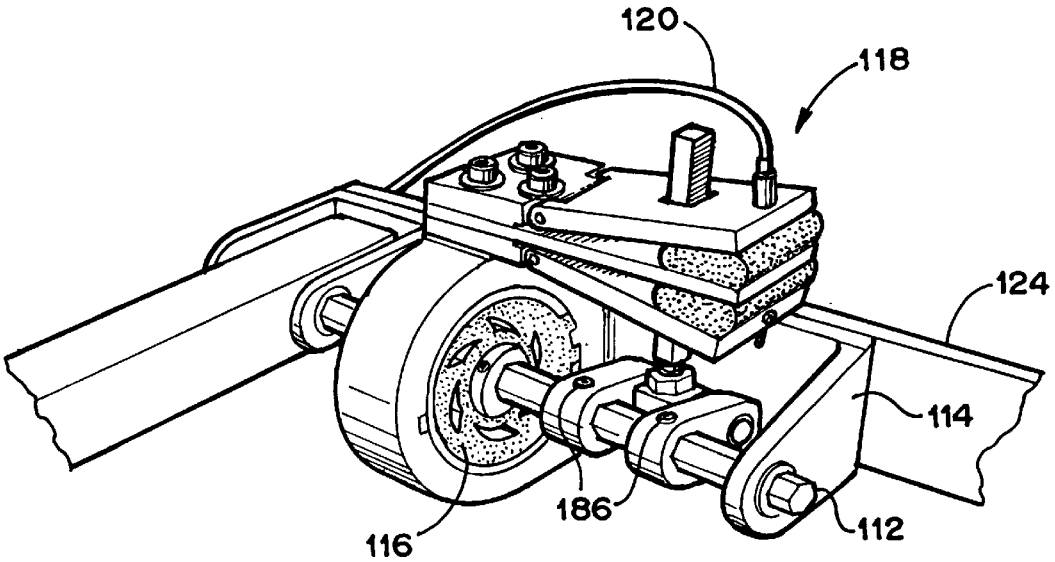
FIG. 2 is an enlarged detail of the arm adjustment device of FIG. 1.
Figure 3:
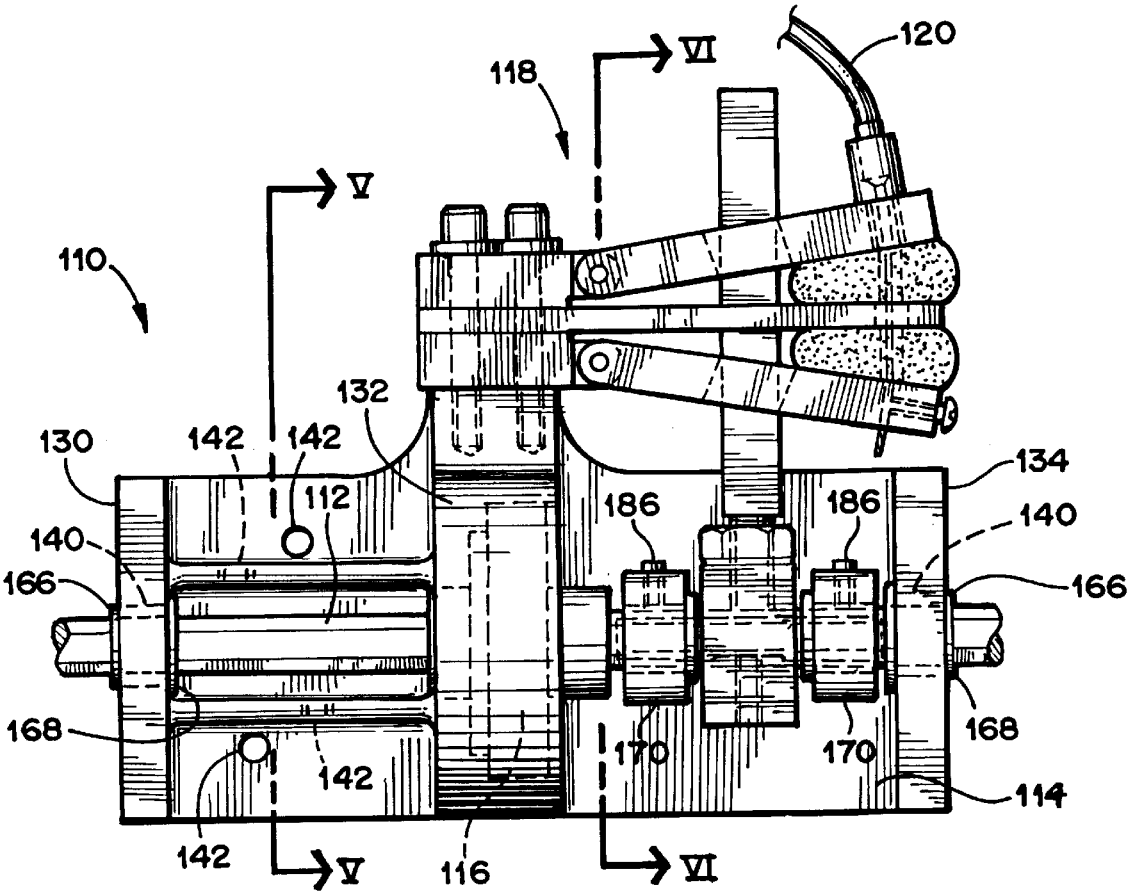
FIG. 3 is a front elevational view of a second embodiment of an arm adjustment device according to the invention.
Figure 4:
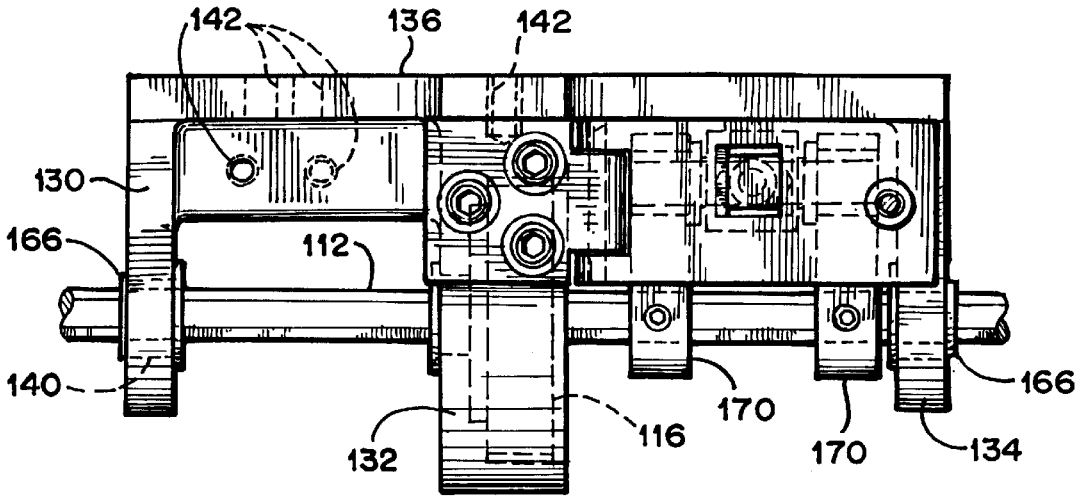
FIG. 4 is a top plan view thereof.
Figure 5:
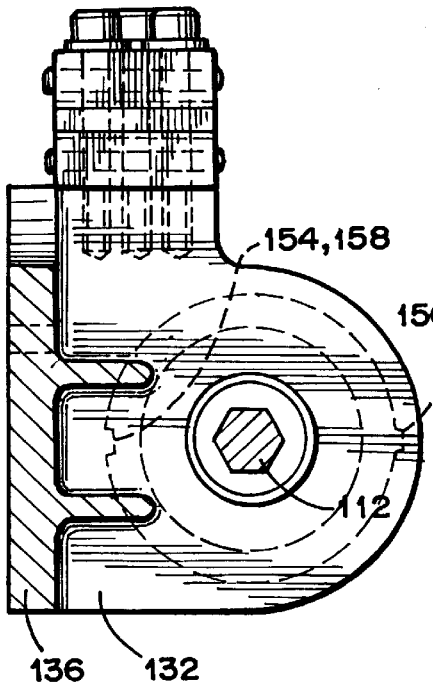
FIG. 5 is a cross-sectional view along section line V—V of FIG. 3.
Figure 6:
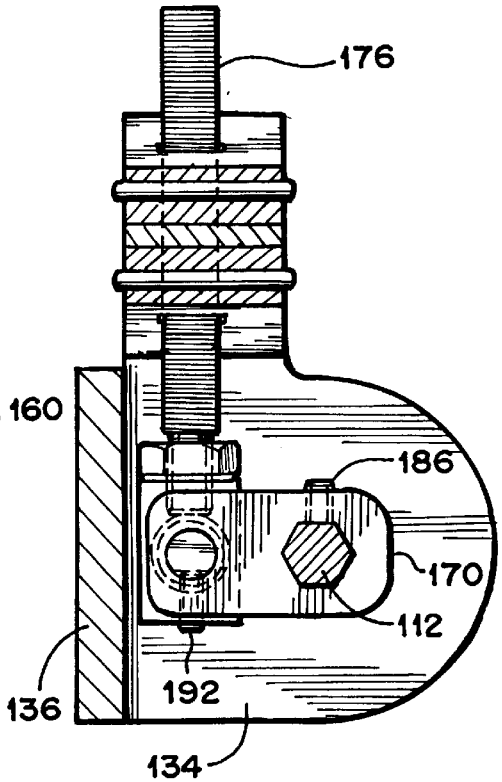
FIG. 6 is a cross-sectional view along section line VI—VI of FIG. 3.
Figure 7:
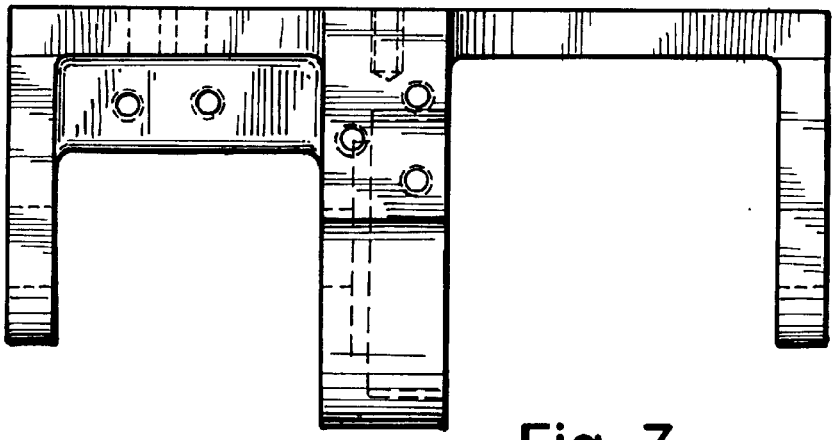
FIG. 7 is a top plan view of the frame of the arm adjustment device of FIG. 3.
Figure 8:
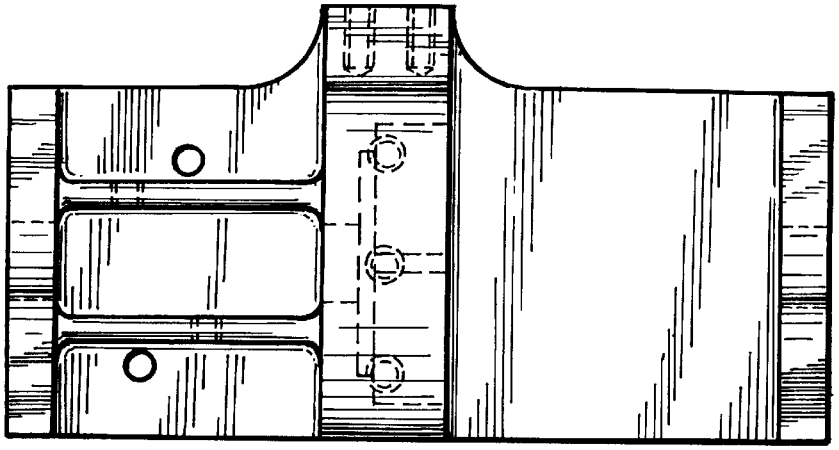
FIG. 8 is a front elevational view thereof.
Figure 9:
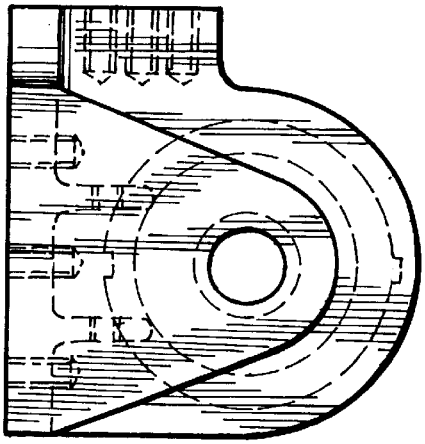
FIG. 9 is a left end elevational view thereof.
Figure 10:
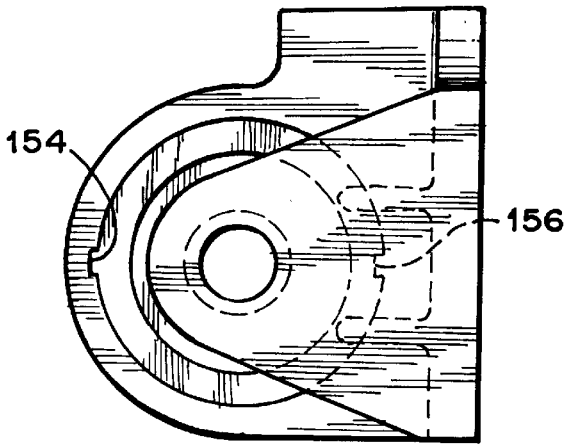
FIG. 10 is a right end elevational view thereof.
Figure 11:
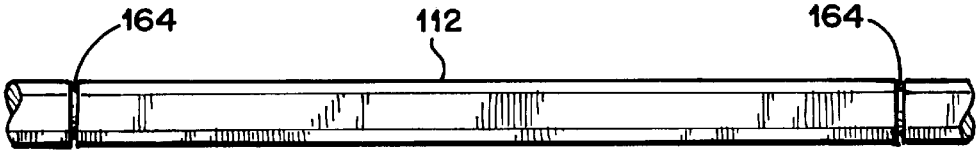
FIG. 11 is a side elevational view of a drive rod of the arm adjustment device of FIG. 3.
Figure 12:
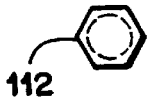
FIG. 12 is an end elevational view thereof.
Figure 13:
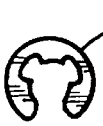
FIG. 13 is a plan view of a retainer ring for the drive rod.
Figure 14:
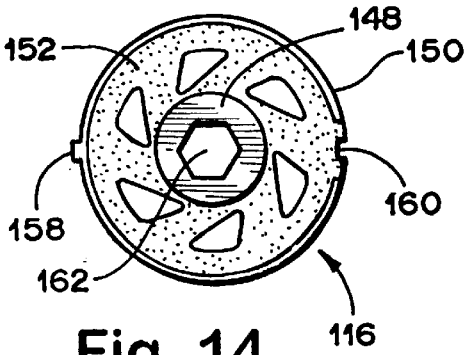
FIG. 14 is an end elevational view of a torque member of the arm adjustment device of either FIGS. 2 or 3.
Figure 15:
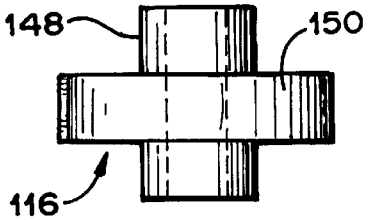
FIG. 15 is a side elevational view thereof.
Figure 16:
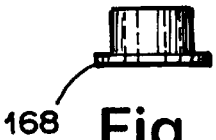
FIG. 16 is a side elevational view of a hex bushing for the drive rod.
Figure 18:
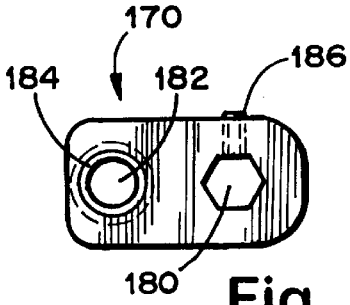
FIG. 18 is a side elevational view of a lever arm of the arm adjustment device of either FIGS. 2 or 3.
Figure 17:
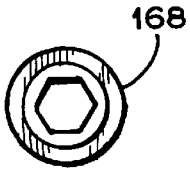
FIG. 17 is an end elevational view thereof.
Figure 19:
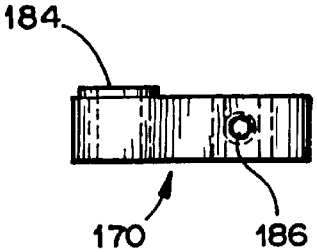
FIG. 19 is an edge elevational view thereof.
Figure 21:
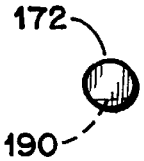
FIG. 21 is an end elevational view thereof.
Figure 20:
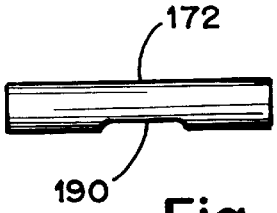
FIG. 20 is a side elevational view of a drive pin.
Figure 29:
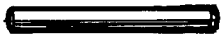
FIG. 29 is a side elevational view of a hinge pin.
Figure 30:
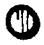
FIG. 30 is an end elevational view thereof.
Figure 35:
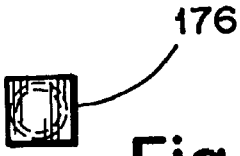
FIG. 35 is a top plan view thereof.
Figure 32:
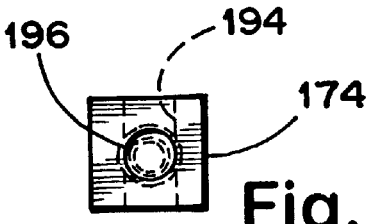
FIG. 32 is a top plan view thereof.
Figure 31:
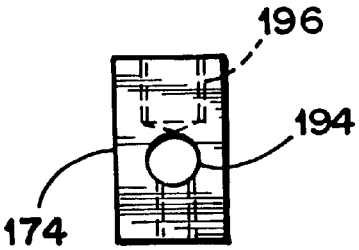
FIG. 31 is a side elevational view of a drive block.

Because the middle flange is thickened to receive the torque member 116, brake mounting holes are conveniently located in the middle flange. Although, one having ordinary skill in the art will realize that the brake 118 may also be mounted to either of the end flanges, and further that the brake 118 may be incorporated in the web portion of the frame 114, all according to the desires of the user for any particular embodiment that incorporates the invention. Further, one having ordinary skill in the art will note that the frame 114 may also be modified to be a generally U-shaped member, having two flanges extending in the same general direction from a web, and will also note that a U-shaped frame 114 is actually shown in the drawing FIGS. 1 and 2.

The torque member 116 is connected between the frame 114 and the drive rod 112 to "pre-load" the arm adjustment device and the arms 106 with a generally upward biasing force to counter balance the weight of the arms. The torque member 116 may be any of various known biasing devices, including a coil or helical spring, for example. Most preferably, the torque member 116 is an elastic torsion spring. Thus, the torque member 116 may comprise a hub and a perimeter collar with an elastic membrane extending between the hub and the collar and being bonded to each of the hub and the collar. Alternatively, the elastic membrane may be a rubber bushing or the like that is force fit into the collar, with the hub being force fit into the bushing. Either way, the elastic membrane or the rubber bushing may be tailored, with the use of commonly known methods and materials, to provide desired torsional spring characteristics for the invention. An off-the-shelf elastic torsion spring that is commonly available has been found to perform satisfactorily.

To provide torsional force transfer between the frame 114 and the torque member 116, the torque member may be keyed to the frame 114 by providing a slot and key in the frame aperture, with corresponding tab and slot being provided on the collar of the torque member 116. To provide torsional force transfer between the hub and the drive rod 112, the drive rod may be provided with a non-circular, preferably polygonal, cross-sectional shape, with the hub being provided with a corresponding hub aperture. As specifically shown in the drawings, the drive rod 112 is a hexagonal rod measuring about 7/16 of an inch across the flats. The drive rod support bearings are, therefor, hex bushings. Also, the drive rod 112 may be milled or turned or the like with retainer seats 164 for holding the drive rod 112 in the frame 114 with C-shaped retainer clips 166, or the like.

The brake 118 comprises a brake rod and crank connection to the drive rod 112 and a jam clutch connection between the brake rod and the frame 114. More specifically, the brake rod and crank connection comprises a pair of lever arms 170, a drive pin 172, a drive block 174, and a brake rod 176. Each of the pair of lever arms 170 may be a generally rectangular or ovoid plate member that has opposing first and second ends. Each lever arm 170 is provided with a hexagonal aperture 180, near the first end, to mount the lever arms 170 on the drive rod 112, with the lever arms 170 extending in the same general direction from the drive rod 112. Each of the two lever arms 170 is also provided with a pin aperture 182, near the second end, to receive a bushing 184 to support the drive pin 172. Set screws 186 or the like may be used, as will be understood by one having ordinary skill in the art, to secure the lever arms 170 to the drive rod 112 and to the drive pin 172 as may be desirable.

The drive pin 172 is a length of 3/8 inch steel rod that extends between the two lever arms 170, and into the bushings 184 in the lever arms 170. The drive pin 172 may have a set flat 190 to cooperate with a set screw 192 or the like of the drive block 174. The drive block 174 may be an about 1¼ inch length of ¾ inch square steel stock that is cross drilled (see 194) to receive the drive pin 172 in sliding engagement. The drive block 174 may also be end drilled and tapped for the set screw 192 to secure the drive block 174 to the drive pin 172. At an opposing end 196, the drive block 174 is drilled and tapped to receive a threaded end 198 of the brake rod 176.

Figure 33:
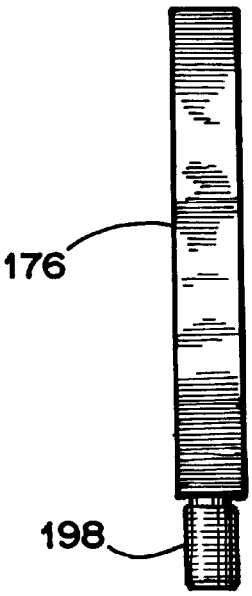
FIG. 33 is a side elevational view of a brake rod.
Figure 34:
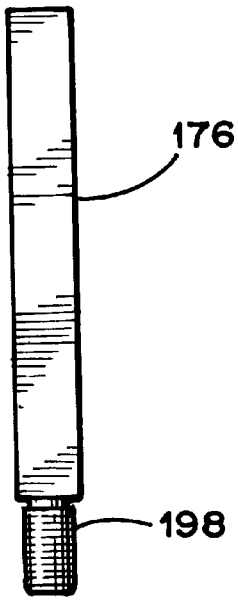
FIG. 34 is a front elevational view thereof.

The brake rod 176 may be a 3⅜ inch length of 7/16 inch square steel stock that has two opposing side surfaces textured (FIG. 33). A relatively short length (about 5/8 inch) of the brake rod 176 is threaded at one of two opposing ends 198 for screw engagement with the drilled and tapped aperture 196 of the drive block 174.

The brake jam clutch comprises a backing plate 200, a top brake clutch 202, a bottom brake clutch 204, two brake springs 206, and the brake actuator 120. The backing plate 200 may be a generally rectangular plate that is about 1½ inches wide, 3⅛ inches long, and about 7/16 inches thick.

The bottom brake clutch 204 is substantially an about 1¼ inch wide, 3⅛ inch long, and 3/8 inch thick articulated member having a hinge plate 208 and a clutch plate 210. The hinge plate 208 is also a generally rectangular member that is about 1¼ inches wide by 1 3/16 inches long, and 7/16 inch thick. A hinge tongue 212 extends about 7/16 of an inch out from one of the two long sides of the hinge plate 208, in a direction generally away from the opposing long side of the hinge plate 208. The tongue 212 is generally centered on the side of the hinge plate 208, and is cut down to a width of about ¾ inch and may be milled back about 1/16 of an inch from one face of the hinge plate 208. The tongue 212 extends about 7/16 of an inch out from the side of the hinge plate 208.

The clutch plate 210 is an about 2⅞ inch long plate having a width of about 1¼ inch and a thickness of about 3/8 inch. The clutch plate 210 has a cooperating notch 214, corresponding to the tongue 212 of the hinge plate 208. An about ½ inch by 9/16 inch jam hole 216 extends through the clutch plate 210 for the brake rod 176 to extend through the clutch plate 210. The two short sides of the jam hole 216 are slightly sloped, or beveled, as shown (FIGS. 26 & 27). The bottom brake clutch plate 210 also has an actuator cable aperture 218 and cooperating set screw 220 for clamping a brake actuator cable 222. The top brake clutch 202 is substantially similar to the bottom brake clutch 204, with the only notable distinction being a reverse of the slant for the two beveled sides of the brake rod jam hole 216.

The jam clutch is assembled with the backing plate 200 sandwiched between each of the upper and lower clutch plates 210. The springs 206 or the like are interposed between the backing plate 200 and the clutch plates 210, to hold the clutch plates spaced from the backing plate 200, in an engaged position. The clutch springs 206 may be a helical coil or a leaf spring, for example. Most preferably, the clutch springs 206 are resilient pad springs, that is pads of resilient, compressible material.

In operation, the upper and lower clutch plates 210 will normally be held by the springs 206 to engage the brake rod 176. With the clutch plates 210 engaging the brake rod 176, the upper clutch plate 210 will resist and upward movement of the brake rod 176, while the lower clutch plate 210 will resist a downward movement of the brake rod 176. Thus, in combination, the clutch plates 210 will preclude or resist either upward or downward movement of the brake rod 176. Activation of the brake actuator 120 will draw the two clutch plates 210 toward one another, against the clutch springs 206, to release engagement of the clutch plates 210 from the brake rod 176. So disengaged, the rod 176 is free to move upward and downward relative to the brake 118 and frame 114.

With the brake actuator 120 activated and the brake clutch plates 210 disengaged, the arms 106 may be adjusted upward and downward. When the arms 106 are adjusted downward, the drive rod 112 rotates in a first direction with the lever arms 170 rotating with the drive rod 112 to crank the drive pin 172, drive block 174, and brake rod 176 in a generally upward direction. Conversely, when the arms 106 are adjusted upward, the lever arms 170 rotate with the drive rod 112 to move in an opposing, downward direction. The elastic torsion spring 116 applies a torsional force to the drive rod 112 to counterbalance the weight of the arms 106. Thus, a user may adjust the arms 106 with ease, not fighting the weight of the arms 106 themselves.

It will be understood by one having ordinary skill in the art and by those who practice the invention, that various modifications and improvements may be made without departing from the spirit of the disclosed concept. Various relational terms, including left, right, front, back, top, and bottom, for example, are used in the detailed description of the invention and in the claims only to convey relative positioning of various elements of the claimed invention. The scope of protection afforded is to be determined by the claims and by the breadth of interpretation allowed by law.

I claim:

1. A chair comprising:

a base;

a seat supported by the base;

a back connected with the base;

an arm rotatably connected with the base, so the arm is rotatable between lowered and raised positions; and an arm adjustment device connected between the arm and the base, the device having a drive rod, a frame that holds the drive rod in rotating engagement, a torque member operatively connected between the frame and the drive rod, a brake operatively connected with one of the frame and the drive rod, a cooperating clutch operatively connected with the other of the frame and the drive rod, and a clutch actuator operatively connected with the clutch, the torque member applying a torsional force to the drive rod, the clutch having locked and released modes, with the clutch slideably engaging the brake when the clutch is in the released mode, and the clutch releasably grasping and holding the brake when the clutch is in the locked mode, and the clutch actuator manipulating the clutch between the locked and released modes, whereby the arm is rotatable to and lockable at any user selected rotational position between the lowered and raised positions.

2. The chair defined in claim 1, wherein the brake is an elongated member with a longitudinal axis, and wherein the brake moves forth and back along the axis when the arm is rotated by the user between the lowered and raised positions.

3. The chair defined in claim 2, wherein the clutch further includes a base plate and a jam plate, the base plate having a base aperture extending therethrough and being positioned with the brake extending through the base aperture, the base aperture corresponding to and cooperating with the brake so the brake and base plate are in sliding engagement, the jam plate having a jam aperture extending therethrough, the jam plate being hingedly connected with the base plate and positioned with the brake extending through the jam aperture, the jam plate hinging between released and locked positions, the jam aperture cooperating with the brake so the brake and jam plate are in sliding engagement when the jam plate is in the released position, and so the brake is grasped and held from moving in at least one of the forth and back directions along the axis when the jam plate is in the locked position.

4. The chair defined in claim 1, wherein the torque member biases the arm toward the raised position.

5. A chair comprising:

a base;

a seat supported by the base;

an arm connected with the base;

a pivot interposed between the arm and the base so the arm is rotatable between lowered and raised positions;

a brake member operatively connected with one of the base and the arm;

a cooperating clutch operatively connected with the other of the base and the arm, the clutch having locked and released modes, with the clutch slideably engaging the brake member when the clutch is in the released mode and the clutch releasably grasping and holding the brake member when the clutch is in the locked mode; and a clutch actuator operatively connected with the clutch, the clutch actuator manipulating the clutch between the locked and released modes, whereby the arm is rotatable to and lockable at any user selected rotational position between the lowered and raised positions.

6. The chair defined in claim 5, further including a bias member operatively connected between the frame and the arm, the bias member biasing the arm toward the raised position.

7. The chair defined in claim 6, wherein the brake member is an elongated member with a longitudinal axis, and wherein the brake member moves forth and back along the axis when the arm is rotated by the user between the lowered and raised positions.

8. The chair defined in claim 7, wherein the clutch further includes a base plate and a jam plate, the base plate having a base aperture extending therethrough and being positioned with the brake member extending through the base aperture, the base aperture corresponding to and cooperating with the brake member so the brake member and base plate are in sliding engagement, the jam plate having a jam aperture extending therethrough, the jam plate being hingedly connected with the base plate and positioned with the brake member extending through the jam aperture, the jam plate hinging between released and locked positions, the jam aperture cooperating with the brake member so the brake member and jam plate are in sliding engagement when the jam plate is in the released position, and so the brake member is grasped and held from moving in at least one of the forth and back directions along the axis when the jam plate is in the locked position.

9. The chair defined in claim 5, wherein the brake member is an elongated member with a longitudinal axis, and wherein the brake member moves forth and back along the axis when the arm is rotated by the user between the lowered and raised positions.

10. The chair defined in claim 9, wherein the clutch further includes a base plate and a jam plate, the base plate having a base aperture extending therethrough and being positioned with the brake member extending through the base aperture, the base aperture corresponding to and cooperating with the brake member so the brake member and base plate are in sliding engagement, the jam plate having a jam aperture extending therethrough, the jam plate being hingedly connected with the base plate and positioned with the brake member extending through the jam aperture, the jam plate hinging between released and locked positions, the jam aperture cooperating with the brake member so the brake member and jam plate are in sliding engagement when the jam plate is in the released position, and so the brake member is grasped and held from moving in at least one of the forth and back directions along the axis when the jam plate is in the locked position.

* * * * *